US005749299A

United States Patent [19]

Barrois et al.

[11] Patent Number: 5,749,299

[45] Date of Patent: May 12, 1998

[54] METHOD AND APPARATUS FOR FASTENING AND CLAMPING PRINTING PLATES WITH BEVELED EDGES

[75] Inventors: Claus Dieter Barrois, Erlenbach; Georg Johann Lindner, Veitshöchheim; Hans-Jürgen Zelfel, Würzburg, all of Germany

[73] Assignee: Koenig & Bauer-Albert Aktiengesellschaft, Wurzburg, Germany

[21] Appl. No.: 716,933

[22] Filed: Oct. 7, 1996

[30] Foreign Application Priority Data

Oct. 7, 1995 [DE] Germany ..... 195 37 420.7

[51] Int. Cl.[6] ..... B41F 27/12

[52] U.S. Cl. ..... 101/483; 101/415.1

[58] Field of Search ..... 101/415.1, 483

[56] References Cited

U.S. PATENT DOCUMENTS

| | | | |
|---|---|---|---|
| 469,226 | 2/1892 | Boardman | 101/415.1 |
| 1,604,082 | 10/1926 | Smothers | 101/415.1 |
| 1,858,305. | 5/1932 | Meisel et al | 101/415.1 |
| 2,051,858 | 8/1936 | Huck et al. | 101/415.1 |
| 2,409,536 | 10/1946 | Braunworth | 101/415.1 |
| 3,020,842 | 2/1962 | Neal | 101/415.1 |
| 3,362,327 | 1/1968 | Luehrs | 101/415.1 |
| 4,546,702 | 10/1985 | Dorow | 101/415.1 |
| 4,552,068 | 11/1985 | Bernauer et al. | 101/415.1 |
| 5,272,978 | 12/1993 | Wehle et al. | 101/415.1 |
| 5,337,666 | 8/1994 | Becker | 101/415.1 |
| 5,566,615 | 10/1996 | Barrois | 101/415.1 |

FOREIGN PATENT DOCUMENTS

| | | |
|---|---|---|
| 0 124 008 | 11/1984 | European Pat. Off. . |
| 0 132 532 | 9/1986 | European Pat. Off. . |
| 641 173 | 1/1937 | Germany . |
| 27 20 673 | 11/1978 | Germany . |
| 80 34 630 | 9/1983 | Germany . |
| 33 00 678 | 4/1988 | Germany . |
| 42 22 332 | 1/1994 | Germany . |
| 44 20 314 | 12/1995 | Germany . |
| 514118 | 10/1939 | United Kingdom . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A flexible plate, such as a printing plate or a blanket support plate, is clamped on the surface of a cylinder by rotation of a clamping spindle that carries a movable plate end suspension lip. The clamping spindle is shiftably supported in the cylinder and moves radially out with respect to the cylinder as a full clamping torque is applied to it.

7 Claims, 2 Drawing Sheets

METHOD AND APPARATUS FOR FASTENING AND CLAMPING PRINTING PLATES WITH BEVELED EDGES

FIELD OF THE INVENTION

The present invention is directed generally to a method and apparatus for fastening and clamping printing plates with beveled edges. More particularly, the present invention is directed to a method and apparatus for fastening and clamping printing plates with beveled edges on a plate cylinder of a rotary printing press. Most specifically, the present invention is directed to a method and apparatus for fastening and clamping beveled end plates on a plate cylinder by means of a suspension lip formed on a rotatable clamping spindle that is supported in the plate cylinder by a resilient molded support. As the clamping spindle, which carries the plate end suspension lip, is rotated to a plate clamping position, its pivot axis changes in its molded resilient support due to a torque applied to a spindle. This shifting of the clamping spindle brings an exterior surface of the suspension lip into alignment with the outer contour of the plate cylinder.

DESCRIPTION OF THE PRIOR ART

Flexible printing plates and rubber blanket support plates are typically provided with beveled or angled leading and trailing ends that are used to secure the plate or blanket support onto the surface of a plate or other support cylinder in a rotary printing press. The plate or support cylinder is provided with plate end engaging suspension edges or lips which are shaped to cooperatively engage the beveled or angled plate ends. Either or both of the plate suspension edges may be movable to effect both a clamping and a fastening of the flexible plate or blanket support on the surface of the plate cylinder.

One prior art clamping assembly is shown in European patent Publication EP 0 124 008A2. This publication describes a plate cylinder which is usable to clamp flexible printing plates through the use of clamping devices that engage the beveled or angled ends of the plate. The clamping devices are arranged in a trough or a channel in the cylinder and are configured as generally triangular segmented bodies which are provided with a suspension edge. The exterior surface of the clamping devices cover the trough gap in the cylinder when the printing plate is clamped in place. The exterior surfaces of the clamping devices are configured to match the contour of the plate cylinder.

Various other prior art devices that are usable for fastening and clamping printing plates with beveled or angled edges on a plate cylinder of a rotary printing press are shown in German Patent Publications DE 33 00 678 C2; DE 44 20 314 A1; DE 80 34 630 U1, and from European Patent Publication EPO 132 532 B1. In these various prior art devices, the clamping spindle typically rotates about a fixed axis and is attached to the plate cylinder for rotation about this axis. Such a fixed securement of the pivot shaft that carries the suspension edge may not provide a smooth cylinder contour and may also leave a somewhat wide, axially extending cylinder channel gap.

It will be seen that a need exists for a flexible plate clamping method and apparatus which overcomes the limitations of the prior art. The method and apparatus for fastening and clamping printing plates with beveled ends in accordance with the present invention provides such a result and is a significant improvement over the prior art.

SUMMARY OF THE INVENTION

It is an object of the present invention to provide a method and apparatus for fastening and clamping printing plates with beveled edges.

Another object of the present invention is to provide a method and apparatus for fastening and clamping printing plates with beveled edges on a plate cylinder of a rotary printing press.

A further object of the present invention is to provide a method and apparatus for fastening and clamping a printing plate with beveled edges on a plate cylinder by use of a suspension lip formed on a rotatable clamping spindle that is supported in the plate cylinder by a resilient molded support.

As will be set forth in detail in the description of the preferred embodiment, which is presented subsequently, the fastening and clamping of plate cylinders with beveled edges on the surface of a cylinder, such as a plate cylinder, in a rotary printing press is accomplished in accordance with the present invention by providing a clamping spindle that carries a suspension lip which provides one of the plate beveled end receiving suspension edges. The clamping spindle is positioned in an axially extending cylinder trough and is rotatable about a first axis of rotation by a worm gear assembly. The clamping spindle supports the plate end engaging suspension lip which has an exterior surface that is configured to be a portion of the profiled exterior surface of the cylinder. The clamping spindle is supported in the cylinder by a resilient, moldable support. As the spindle is rotated about its first axis of rotation, an interior resting surface of the suspension lip moves into abutment against an interior support surface on the cylinder trough. Since the clamping spindle is supported in the resilient molded support, the axis of rotation of the spindle will become shifted from that of its first location to the point of contact between the interior resting surface and the interior support surface.

A primary advantage of the method and apparatus for fastening and clamping printing plates with beveled ends in accordance with the present invention is that the surface of the cylinder is rendered more gap free and more uniform in contour than has been the case with the prior art devices. The printing plate is secured to the cylinder in a manner which essentially allows printing even over the suspension lip during the printing process. The suspension lip is also seated in a manner which is free of play. This means that interference with the printing because of movements of the suspension lip, is eliminated as a problem. The clamping spindle is supported by a resilient molded support in the cylinder trough. When the clamping spindle is in its fully clamped position, the molded support mass is free of forces acting on it.

The method and apparatus for fastening and clamping printing plates with beveled ends on a plate cylinder in accordance with the present invention overcomes the limitations of the prior art. It is a substantial advance in the art.

BRIEF DESCRIPTION OF THE DRAWINGS

While the novel features of the method and apparatus for fastening and clamping printing plates on a plate cylinder of a rotary printing press in accordance with the present invention are set forth with particularity in the appended claims, a full and complete understanding of the invention may be had by referring to the detailed description of the preferred embodiment, which is presented subsequently, and as illustrated in the accompanying drawings, in which:

DETAILED DESCRIPTION OF THE PREFERRED EMBODIMENT

Figure 1:
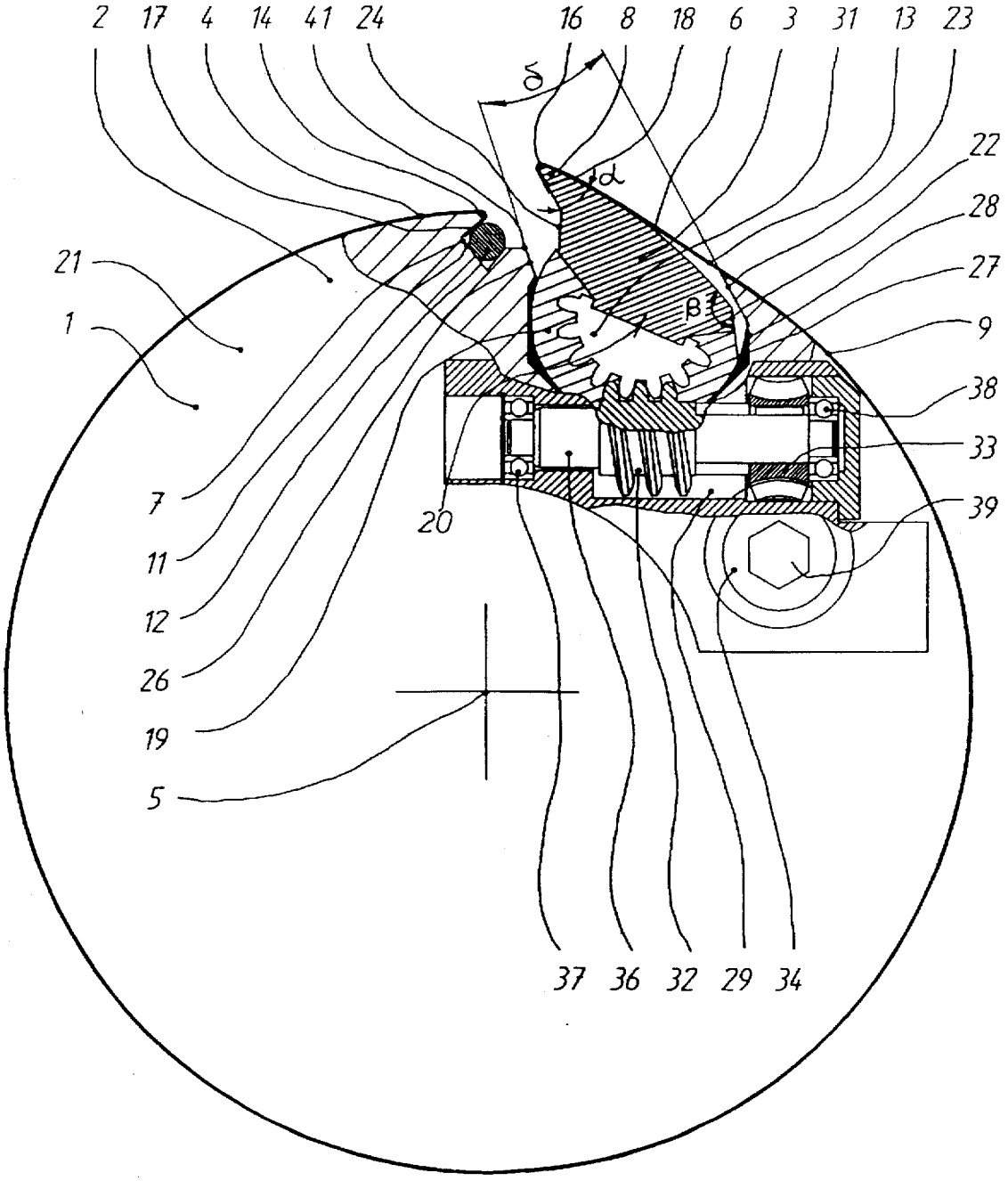
FIG. 1 is a schematic end view, partly in cross-section of a preferred embodiment of the device for fastening and clamping plates with beveled ends onto a cylinder in accordance with the present invention, and showing the device in a plate suspension position.

Referring initially to FIG. 1, there may be seen, generally at 1, a plate cylinder of a rotary printing press. It will be understood that plate cylinder 1 is representative of various cylinders that are adapted to receive and to hold flexible plates, such as flexible printing plates or flexible blanket support plates. It will also be understood that plate cylinder 1 is typically utilized in a generally conventional rotary printing press which will not be further described or depicted since it forms no part of the present invention.

The plate cylinder 1 of the rotary printing press has a left, fixed suspension lip 2 and a right movable suspension lip 3, which are each defined by exterior surfaces 4 and 6 and by interior surfaces 7 and 8, respectively. The exterior surfaces 4 and 6 each form an acutely angled opening angle $\alpha$ of, for example 45°, with the respective interior surfaces 7 or 8, and each exterior surface is matched to a curvature of a contour 9 of the plate cylinder 1.

Figure 2:
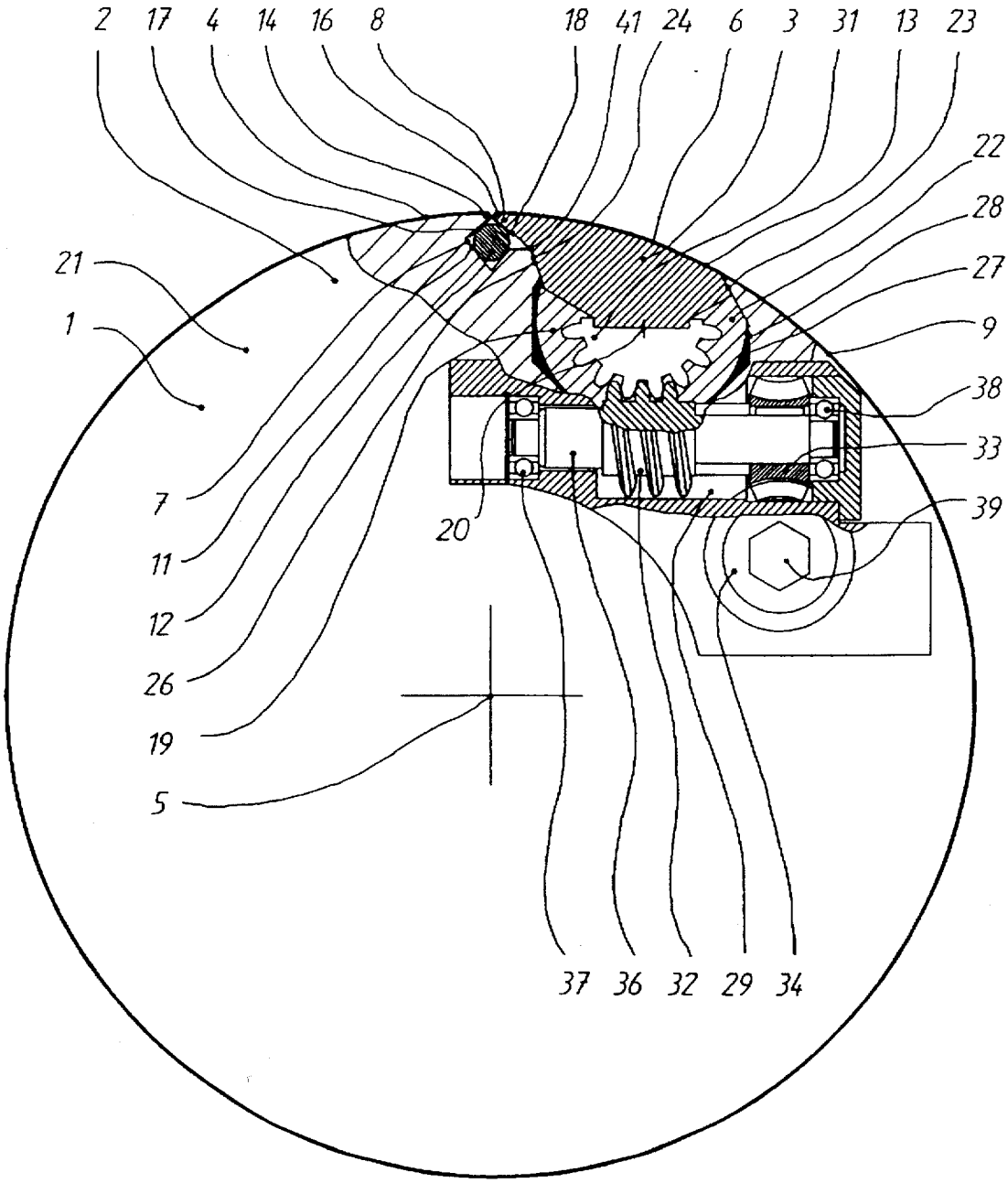
FIG. 2 is a schematic end view of the device shown in FIG. 1 and showing the invention in the plate clamped position.

These suspension lips 2 and 3 extend parallel with an axis of rotation 5 of the plate cylinder 1 and are bounded at their exterior surfaces 4 and 6 by the contour 6 of the plate cylinder 1. A channel 11 with, for example, a U-shaped cross section, extends axially below the left suspension lip 2. A seal 12, for example a ring-shaped seal, is inserted into the channel 11. A printing plate 13 or a support plate of a rubber blanket is provided with beveled edges 14 and 16, as may be seen in FIGS. 1 and 2 and is suspended by its beveled edges 14 and 16 in the suspension lips 2 and 3. Beveled legs 17 and 18 of these beveled edges 14 and 16 also form an opening angle a of, for example 45°, with the printing plate, which is matched to the suspension lips 2 and 3.

The left suspension lip 2 has been directly formed out of the plate cylinder 1, while the right suspension lip 3 is formed as part of a pivotably disposed clamping spindle 19, for example. It is also possible to make both suspension lips 2 and 3 pivotable. In a plate end clamping state, the clamping spindle 19 continuously and without a shoulder extends with its suspension lip 3 along the contour 9 of the plate cylinder 1. The clamping spindle thus provides the outer surface 6 of the right plate suspension lip 3 having a curvature that matches the contour 9 of the plate cylinder 1.

A trailing suspension lip surface 22, which forms an opening angle $\beta$ of, for example $\beta$=150°, with the exterior surface 6 of the right suspension lip, follows or trails this exterior surface 6 of the suspension lip 3 in the direction toward an interior portion 21 of the plate cylinder 1. A trailing abutment support surface 23, which is matched in shape to this trailing suspension lip surface 22, is formed on an interior edge of the plate cylinder 1 adjacent the clamping spindle 19. A movable suspension lip resting surface 24 is disposed approximately opposite this trailing suspension lip surface 22 on an underside of the plate receiving tip of the suspension lip 3. A movable suspension lip support surface 26 is directly formed on the interior 21 of the plate cylinder 1. The two support surfaces 23 and 26 do not extend parallel to each other and preferably form an angle $\sigma$ of 15 ° to 30° with each other, i.e. the two support surfaces 23, 26 are arranged with each other so they taper toward the exterior of the plate cylinder 1. The clamping spindle 19 is pivotable around its pivot axis 20, and is supported by a hardened resilient molded support 28 that is embodied in the shape of a shell in a cylinder trough 27.

The pivot movement of the clamping spindle 19 for clamping and releasing of the printing plate 13 is generated by means of a worm gear drive 29 that is situated at a first end of the clamping spindle 19. This self-locking worm gear drive 29 essentially consists of a clamping spindle toothed segment 31, a first worm gear 32, a worm ring wheel 33 and a second worm gear 34. The first worm gear 32 is fastened, together with the worm ring wheel 33, on a rotatably seated shaft 36. This shaft 36 is disposed at right angles with respect to the clamping spindle on an end face of the plate cylinder 1 and is supported in two bearings 37 and 38. The first worm gear 32 of this shaft 36 meshes with the toothed segment 31, which is fastened on the front end of the clamping spindle 19, while the worm ring wheel 33 meshes with the second worm gear 34. In the present preferred embodiment, the second worm gear 34 is provided with a hexagon drive port 39 for transmitting a rotary movement to the second worm gear 34. Other actuating drives are possible such as, for example, step motors. Other drives for generating the pivot movement of the clamping spindle 19 are also possible in place of the worm gear 29 drive.

The operation of the apparatus for fastening and clamping printing plates with beveled edges will now be discussed in detail. The beveled leading end 14 of the printing plate 13 is first suspended in the stationary suspension lip 2 at the start of the print and then, for example after one revolution, the plate trailing end 16 is suspended in the opened, or outward pivoted, suspension lip 3 at the print end. It is also possible to dispose the stationary suspension lip 2 at the print end and the pivotable suspension lip 3 at the print start and to make possible a reversal of direction of the plate cylinder 1 in this way. In other words, the end 14 of the flexible plate 13, that contains the start of the material to be printed, can be attached to the stationary suspension lip 2 and the portion of the plate 13, that contains the end of the material to be printed, can be attached to the suspension 3 which has been pivoted outwardly to the position depicted in FIG. 1. It is clearly also possible to attach plate 13 to cylinder 1 in a reversed orientation with the start of print end being attached to the suspension lip 3.

Once the two beveled ends 14 and 16 have been placed on the fixed and movable suspension lips 2 and 3, a suitable tool will be placed in engagement with the hexagon 39 and will be rotated. This will effect a rotation of the second worm gear 34, and, in turn, a rotation of the worm ring wheel 33, the shaft 36, the first worm gear 32, and the toothed segment 31. Since the toothed segment 31 is attached to the clamping spindle 19, the spindle 19 will also turn or rotate about its axis of rotation 20. This movement of the clamping spindle 19 will cause the movable suspension lip 3 to turn in a manner so that the suspension edge of suspension lip 3 moves toward the interior 21 of the plate cylinder 1. This effects a clamping of the printing plate 13. As the clamping end state is started to be reached, movable suspension lip resting surface 24 moves into engagement with the movable suspension lip support surface 26. As the worm gear drive 29 is continued to be operated, the torque that is imparted to the clamping spindle 19 causes the axis of rotation of the spindle 19 to shift from its original point 20 to a new, second pivot axis 41 that is situated at the point of contact between the movable suspension lip resting surface 24 and the movable suspension lip support surface 26. The clamping spindle 19 is now lifted up and off the hardened, resilient molded, support 28. The movement of the clamping spindle is now generally radially outwardly so that the trailing suspension lip surface 22 of the spindle 19 will now engage the trailing abutment support surface 23 of the cylinder 1. A defined end clamping position, that is free of play, is attained by the end clamping spindle 19. In this defined end clamping position, the exterior surface 6 of the movable suspension lip 3 is smoothly aligned with the contour 9 of the cylinder 1. The attainment of this defined end clamping position can be accomplished because of the play that exists between the clamping spindle 19 and the hardened, resilient molded support 28.

The movable suspension lip 3 could be supported in the cylinder trough 27 by an arrangement other than the hardened, resilient molded support 28. For example, the clamping spindle 19 could be supported at its two ends in two bearing rings. In this type of support, the interior diameter of the bearing rings will be slightly larger than the exterior diameter of the clamping spindle 19 that is supported by these two bearing rings. In any arrangement, the support for the clamping spindle 19 is provided as a bearing or other support that limits the movement of the clamping spindle 19 but which allows sufficient displacement to bring the movable suspension lip resting surface 24 into contact with the movable suspension lip support surface 26. In each configuration of the support for the clamping spindle 19, this spindle is supported for limited radial displacement with respect to the plate cylinder 1. The clamping spindle 19 will shift generally radially outwardly in the cylinder trough 27 in the direction of the outer contour 6 of the printing cylinder 1.

While a method and apparatus for fastening and clamping printing plates with beveled edges in accordance with the present invention have been set forth fully and completely hereinabove, it will be apparent to one of skill in the art that a number of changes in, for example, the overall size of the cylinder, the type of printing being accomplished, the drive assembly for the cylinder and the like may be made without departing from the true spirit and scope of the present invention which is accordingly to be limited only by the following claims.

What is claimed is:

1. A method for fastening and clamping a printing plate having beveled ends on a plate cylinder of a rotary printing press including:

providing a rotatable clamping spindle having a suspension lip and an axis of rotation in the plate cylinder;

supporting said clamping spindle for rotation in a cylinder trough of the plate cylinder;

locating said clamping spindle axis of rotation at a first point;

providing a movable suspension lip resting surface and a trailing suspension lip surface on said suspension lip;

providing a movable suspension lip support surface and a trailing abutment support surface in said cylinder trough;

rotating said clamping spindle about said axis of rotation located at said first point;

bringing said movable suspension lip resting surface into contact with said movable suspension lip support surface;

shifting said clamping spindle in said cylinder trough;

locating said clamping spindle axis of rotation at a second point in response to said shifting of said clamping spindle;

bringing said trailing suspension lip surface into contact with said trailing abutment support surface by rotating said clamping spindle about said axis of rotation located at said second point; and situating said clamping spindle in a defined end clamping position.

2. The method of claim 1 further including providing said second point for said location of said axis of rotation of said clamping spindle at a point of contact between said movable suspension lip resting surface and said movable suspension lip support surface, and pivoting said suspension lip in a direction of an outside contour of said plate cylinder when said axis of rotation of said clamping spindle is at said second point.

3. A device for fastening and clamping printing plates having beveled ends on a plate cylinder of a rotary printing press comprising:

a movable plate end suspension lip rotatable about an axis of rotation, and shiftable in a cylinder trough in the plate cylinder, said axis of rotation being shiftable between a first point and a second point;

a movable suspension lip resting surface and a trailing suspension lip surface formed on said suspension lip;

a movable suspension lip support surface and a trailing abutment support surface on said cylinder trough;

means to apply a torque force to said movable plate end suspension lip; and means to support said movable plate end suspension lip for movement outward toward an outer contour surface of said plate cylinder about said axis of rotation as said axis of rotation is shifted from said first point to said second point which is located at a point of contact of said movable suspension lip resting surface and said movable suspension lip support surface upon application of said torque force, to press said trailing suspension lip surface against said trailing abutment support surface.

4. The device of claim 3 wherein said suspension lip is fastened on a pivotable clamping spindle and further wherein said means to support said movable plate end suspension lip is a resilient molded support for said clamping spindle.

5. The device of claim 3 wherein said suspension lip surfaces and said cylinder trough surfaces each define planes which intersect each other at points outside of said plate cylinder.

6. The device of claim 3 wherein said means to apply a torque force is a self locking worm gear.

7. The device of claim 3 wherein said suspension lip has an outer surface and further wherein in a plate end clamping position of said suspension lip, said outer surface has a contour of said plate cylinder.

* * * * *